US007495223B2

(12) United States Patent
Shimoi et al.

(10) Patent No.: US 7,495,223 B2
(45) **Date of Patent: *Feb. 24, 2009**

(54) PHOTOMULTIPLIER TUBE, PHOTOMULTIPLIER TUBE UNIT, AND RADIATION DETECTOR

(75) Inventors: Hideki Shimoi, Hamamatsu (JP); Akira Atsumi, Hamamatsu (JP); Hiroyuki Kyushima, Hamamatsu (JP)

(73) Assignee: Hamamatsu Photonics K. K., Hamamatsu (JP)

( * ) Notice: Subject to any disclaimer, the term of this patent is extended or adjusted under 35 U.S.C. 154(b) by 10 days.

This patent is subject to a terminal disclaimer.

(21) Appl. No.: 11/898,028

(22) Filed: Sep. 7, 2007

(65) Prior Publication Data

US 2008/0001541 A1 Jan. 3, 2008

Related U.S. Application Data

(63) Continuation of application No. 10/275,654, filed as application No. PCT/JP00/02927 on May 8, 2000, now Pat. No. 7,276,704.

(51) Int. Cl.
*H01J 43/28* (2006.01)

(52) U.S. Cl. ..... 250/368; 250/367; 250/366; 313/532; 65/59.26; 65/59.32; 65/59.7

(58) Field of Classification Search ..... 250/367, 250/366, 368; 313/352; 65/59.26, 59.32, 65/59.7

See application file for complete search history.

(56) References Cited

U.S. PATENT DOCUMENTS 3,441,706 A 4/1969 Steyn
3,683,194 A 8/1972 Levin et al.
3,890,526 A 6/1975 Palac
3,951,698 A 4/1976 Wilson et al.
4,568,567 A 2/1986 Faulkner
4,588,922 A 5/1986 Faulkner
5,336,967 A 8/1994 Tomasetti et al.
5,438,191 A 8/1995 Kimura et al.
5,442,179 A 8/1995 Ohishi (Continued)

FOREIGN PATENT DOCUMENTS

EP 1 304 718 A1 4/2003

(Continued)

*Primary Examiner*—David P Porta
*Assistant Examiner*—Shun Lee
(74) *Attorney, Agent, or Firm*—Oliff & Berridge, PLC

(57) ABSTRACT

A photomultiplier tube, a photomultiplier tube unit, and a performance-improved radiation detector for increasing a fixing area of a side tube in a faceplate while increasing an effective sensitive area of the faceplate. In the photomultiplier tube, a side face (3*c*) of the faceplate (3) protrudes outward from an outer side wall (2*b*) of a metal side tube (2), so that a light receiving area for receiving light passing through a light receiving face (3*d*) of the faceplate (3) is increased. The overhanging structure of the faceplate (3) is conceived based on a glass refractive index. The overhanging structure is aimed to receive light as much as possible which has not been received before. When the metal side tube (2) is fused to the glass faceplate (3), a fusing method is adopted due to joint between glass and metal. Joint operation between the faceplate (3) and the side tube (2) is reliably ensured. Accordingly, the overhanging structure of the faceplate (3) is effective.

16 Claims, 13 Drawing Sheets

U.S. PATENT DOCUMENTS

| | | | | |
|---|---|---|---|---|
| 5,504,386 | A | 4/1996 | Kyushima et al. | |
| 5,594,301 | A | 1/1997 | Sawai et al. | |
| 5,652,429 | A | 7/1997 | Genna | |
| 5,864,207 | A | 1/1999 | Kume et al. | |
| 5,886,465 | A | 3/1999 | Muramatsu et al. | |
| 6,324,870 | B1 | 12/2001 | Chabin et al. | |
| 6,835,922 | B1 | 12/2004 | Shimoi et al. | |
| 6,946,641 | B1 | 9/2005 | Shimoi et al. | |
| 7,141,926 | B2 | 11/2006 | Tomasetti et al. | |
| 7,148,461 | B2 | 12/2006 | Shimoi et al. | |
| 7,276,704 | B1 * | 10/2007 | Shimoi et al. | 250/367 |

FOREIGN PATENT DOCUMENTS

| | | | |
|---|---|---|---|
| EP | 1 304 720 | A1 | 4/2003 |
| JP | U 55-173070 | | 12/1980 |
| JP | A 60-211758 | | 10/1985 |
| JP | A 61-83985 | | 4/1986 |
| JP | A 5-100034 | | 4/1993 |
| JP | A-05-190121 | | 7/1993 |
| JP | A 5-290793 | | 11/1993 |
| JP | A 6-60845 | | 3/1994 |
| JP | A 6-103959 | | 4/1994 |
| JP | A 11-345587 | | 12/1999 |
| JP | A 2000-149860 | | 5/2000 |
| JP | A 2000-149861 | | 5/2000 |

* cited by examiner

PHOTOMULTIPLIER TUBE, PHOTOMULTIPLIER TUBE UNIT, AND RADIATION DETECTOR

This is a Continuation of application Ser. No. 10/275,654 which is a National Phase of Application No. PCT/JP 00/02927 filed May 8, 2000. The disclosure of the prior application is hereby incorporated by reference herein in its entirety.

TECHNICAL FIELD

The present invention relates to a photomultiplier tube for detecting weak light incident on a faceplate by multiplying electrons emitted from the faceplate, a photomultiplier tube unit having photomultiplier tubes arranged, and a radiation detector employing a lot of arranged photomultiplier tubes and/or photomultiplier tube units.

BACKGROUND ART

Japanese patent Kokai publication No. Hei 5-290793 discloses a photomultiplier tube in which an electron multiplier is accommodated in a hermetically sealed vessel. The vessel has a metal side tube having a flange at an upper end. The flange is welded and fixed to an upper surface of a faceplate, thereby ensuring airtightness of the vessel. The flange of the side tube is welded to the faceplate, while the side tube is heated.

However, the following problem arises as to a conventional photomultiplier tube. Referring to FIG. 18, a side tube 100 has a flange 101 provided at the entire upper end thereof. A lower face 101*a* of the flange 101 is in contact with an upper face 102*a* of a faceplate 102, so that the side tube 100 and the faceplate 102 are fused. Such a photomultiplier tube has a flange 101 overhanging the upper face 102*a* of the faceplate 102. The flange 101 covers an edge of the faceplate 102 at an upper end of the side tube 100. The flange 101 narrows the upper face 102*a* of the faceplate 102, thereby decreasing an effective sensitive area of the faceplate 102. Recently, many photomultiplier tubes are frequently arranged in a single detector for a certain application. In this case, it is desired to increase an effective sensitive area of the faceplate 102 even by 1%. The dense arrangement of the photomultiplier tubes in the detector, however, may generate a significant amount of dead space in the detector. Therefore, it is difficult to improve performances of the detector due to the above problem.

In view of the foregoing, it is an object of the present invention to provide a photomultiplier tube having an increased effective sensitive area of the faceplate and an increased fix area of the side tube to the faceplate.

It is another object of the present invention to provide a photomultiplier tube unit having an increased effective sensitive area of the faceplate.

It is further object of the present invention to provide a photomultiplier tube unit facilitating a gain control (current gain) of each electron multiplier in the side tube.

It is still further object to provide a radiation detector having improved performances over the entire detector based on the enlarged effective sensitive area of the faceplate.

DISCLOSURE OF INVENTION

The present invention features a photomultiplier tube having: a photocathode for emitting electrons in response to light incident on a faceplate; an electron multiplier provided in an hermetically sealed vessel for multiplying electrons emitted from the photocathode; and an anode for generating an output signal based on electrons multiplied by the electron multiplier. The hermetically sealed vessel includes: a stem plate having stem pins for fixing the electron multiplier and the anode thereon; a metal side tube enclosing the electron multiplier and the anode, the metal side tube having an open end to which the stem plate is fixed; and the faceplate fixed to another open end of the side tube, the faceplate being made from glass. A side face of the faceplate protrudes out of an outer side wall of the side tube.

In the above photomultiplier tube, a side surface of the glass faceplate protrudes out of the outer side wall of the metal side tube by a predetermined length. Accordingly, the area for receiving light passing through a photocathode 3*a* on the glass faceplate 3 is increased. The above overhang structure of the faceplate 3 is provided on the basis of refractive index of glass. The above structure is directed to receive light which a conventional photomultiplier tube is not capable of receiving. When the metal side tube is fused to the glass faceplate, the fusing method described above is adopted due to joint between glass and metal. The overhanging part of the faceplate is effective at ensuring a reliable operation to fuse the faceplate and the overhanging part. As described above, when the metal side tube is used, the overhanging structure of the faceplate is effective means for increasing a fused area and ensure enlarged light receiving area. The thicker the faceplate is, the more effectively the overhanging structure of the faceplate functions during light reception.

The side tube of the photomultiplier tube according to the present invention has an edge portion on an upper end thereof, the edge portion is to be embedded in a photocathode side of the faceplate. In this case, the edge portion of the side tube is embedded in the glass faceplate so as to strike thereon. Therefore, the side tube conforms to the faceplate well, and hermetic seal between the side tube and the faceplate is enhanced. The edge portion provided in the side tube extends upwardly from the side tube rather than extends laterally from the side tube like a flange. When embedding the edge portion into the glass faceplate as close as possible to a side surface of the faceplate, it is possible to increase the effective sensitive surface area of the glass faceplate as much as possible.

The tip end of the edge portion of the photomultiplier tube may curve toward one of an interior and an exterior of the side tube. The above structure increases a surface are of the edge portion embedded in the faceplate, and improves and enhances the hermetic seal at a joint between the side tube and the faceplate.

In the photomultiplier tube according to the present invention, the edge portion preferably has a knife-edged tip end. This structure enables an end of the side tube to penetrate the faceplate easily. When the glass faceplate is fused to the side tube, an assembly operation and reliability is improved.

When an end of the side tube is fused to the faceplate, the edge portion is heated while being contact with a photocathode side of the faceplate, the contact part of the faceplate is melted due to heat conducted from the edge portion, a pressing force is applied across the edge portion and the faceplate to embed the edge portion into the photocathode side of the faceplate.

In the photomultiplier tube according to present invention, the faceplate has a reflecting member on a side face of the faceplate. In a conventional photomultiplier tube, some of light incident on the faceplate leaks out of a side face of the side tube. Because such light is reflected by the reflecting member provided on the side face, the amount of light incident on the photocathode is increased. The light receiving efficiency at the faceplate is improved.

In order to obtain the above advantages, the faceplate of the photomultiplier tube according to the present has at least a part of a face extending parallel to an axial direction of the side tube. Alternatively, the faceplate has a convex face on at least one part of the side face. The side face is inclined a predetermined angle with respect to an axial direction of the side tube so that an area of a light receiving side of the faceplate is wider than an area of a side of the faceplate facing the photocathode.

A photomultiplier tube unit according to the present invention has a plurality of photomultiplier tubes that are juxtaposed, each of the plurality of the photomultiplier tubes having a photocathode for emitting electrons in response to light incident on a faceplate; an electron multiplier provided in an hermetically sealed vessel for multiplying electrons emitted from the photocathode; and an anode for generating an output signal based on electrons multiplied by the electron multiplier. The hermetically sealed vessel includes: a stem plate having stem pins for fixing the electron multiplier and the anode thereon; a metal side tube enclosing the electron multiplier and the anode, the side tube having one open end to which the stem plate is fixed; and the faceplate fixed to another open end of the side tube, the faceplate being made from glass. The plurality of photomultiplier tube are juxtaposed to integrate the faceplates together and space the side tube away from the other.

In the unit, when the side tubes are arranged, the neighboring side tubes are spaced away from each other while the faceplates are integral with each other. As a result, the faceplates extend over a gap between the neighboring side tubes. Therefore, an effective sensitive area of the faceplate is increased. The faceplates are maintained at the same potential due to the integrated structure of the faceplates. And, the neighboring faceplates are spaced away from each other, which facilitates gain control (current gain) at each electron multiplier section. For example, when a negative high voltage is applied to the photocathode, fine gain adjustment is necessary for each electron multiplier section in order to maintain a constant gain for four intervals between the electron multiplier sections. The unit described above enables this gain control.

In the photomultiplier tube unit according to present invention, the plurality of side tubes are secured to a faceplate while each of the plurality of side tubes is spaced away from each other. When this structure is adopted, integration of the faceplate is performed by a single faceplate. The faceplate obtains uniform quality, which contributes to improved reliability of the unit.

The neighboring side faces of the faceplates are secured together, contacting each other. When the above structure is adopted, a lot of different combinations of a single photomultiplier tube are available by joining the neighboring faceplates together on a single photomultiplier tube. As a result, the photomultiplier tube according to the present invention can be used for any size of a unit.

The neighboring side face of the faceplates are secured through an electrically conductive reflecting member. When the above structure is adopted, electrical conductivity between the neighboring faceplates is ensured. The amount of light incident on the photocathode is increased due to light reflected by the reflecting member. Therefore, light receiving efficiency on the faceplate is improved.

A radiation detector according to the present invention has a scintillator for emitting fluorescent light in response to radiation generated from an object; a plurality of photomultiplier tubes arranged in a manner that faceplates of the photomultiplier tubes face the scintillator, each of the photomultiplier tubes generating an electrical charge based on the fluorescent light emitted from the scintillator; and a position calculating processor for processing an output from the photomultiplier tube and generating a signal for indicating a position of radiation generated in the object. Each of the plurality of photomultiplier tubes has a photocathode for emitting electrons in response to light incident on a faceplate; an electron multiplier provided in an hermetically sealed vessel for multiplying electrons emitted from the photocathode; and an anode for producing an output signal based on electrons multiplied by the electron multiplier. The hermetically sealed vessel includes: a stem plate having stem pins for securing the electron multiplier and the anode thereon; a metal side tube enclosing the electron multiplier and the anode, the side tube having one open end to which the stem plate is fixed; and the faceplate fixed to another open end of the side tube, the faceplate being made from glass. The plurality of side tubes is juxtaposed. The faceplates are integrated with each other. One of the side tubes is spaced away from another of the side tubes.

In the radiation detector, when the side tubes are arranged, the neighboring side tubes are spaced away from each other while the faceplates are integral with each other. As a result, the faceplates extend over a gap between the neighboring side tubes. Therefore, an effective sensitive area of the faceplate is increased. The faceplates are maintained at the same potential due to the integrated structure of the faceplates. And, the neighboring faceplates are spaced away from each other, which facilitates gain control (current gain) at each electron multiplier section. For example, when a negative high voltage is applied to the photocathode, fine gain adjustment is necessary for each electron multiplier section in order to maintain a constant gain for four intervals between the electron multiplier sections. The radiation detector described above enables this gain control, thereby improving the performance over the radiation detector.

BEST MODE FOR CARRYING OUT THE INVENTION

The following description will be made for explaining preferred embodiments of a photomultiplier tube, a photomultiplier tube unit, and a radiation detector according to the present invention in details, referring to the accompanying drawings.

Figure 1:
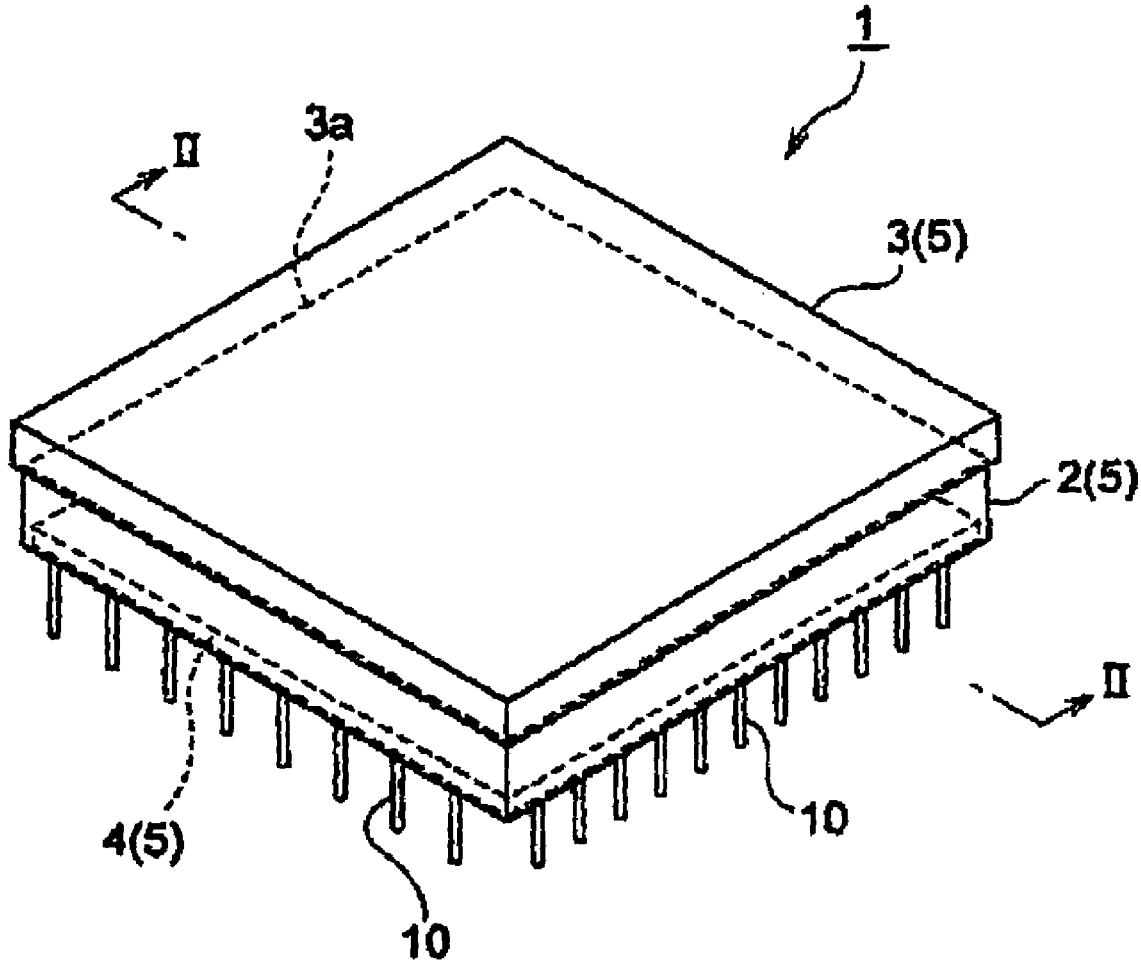
FIG. 1 is a perspective view showing one embodiment of a photomultiplier tube according to the present invention.
Figure 2:
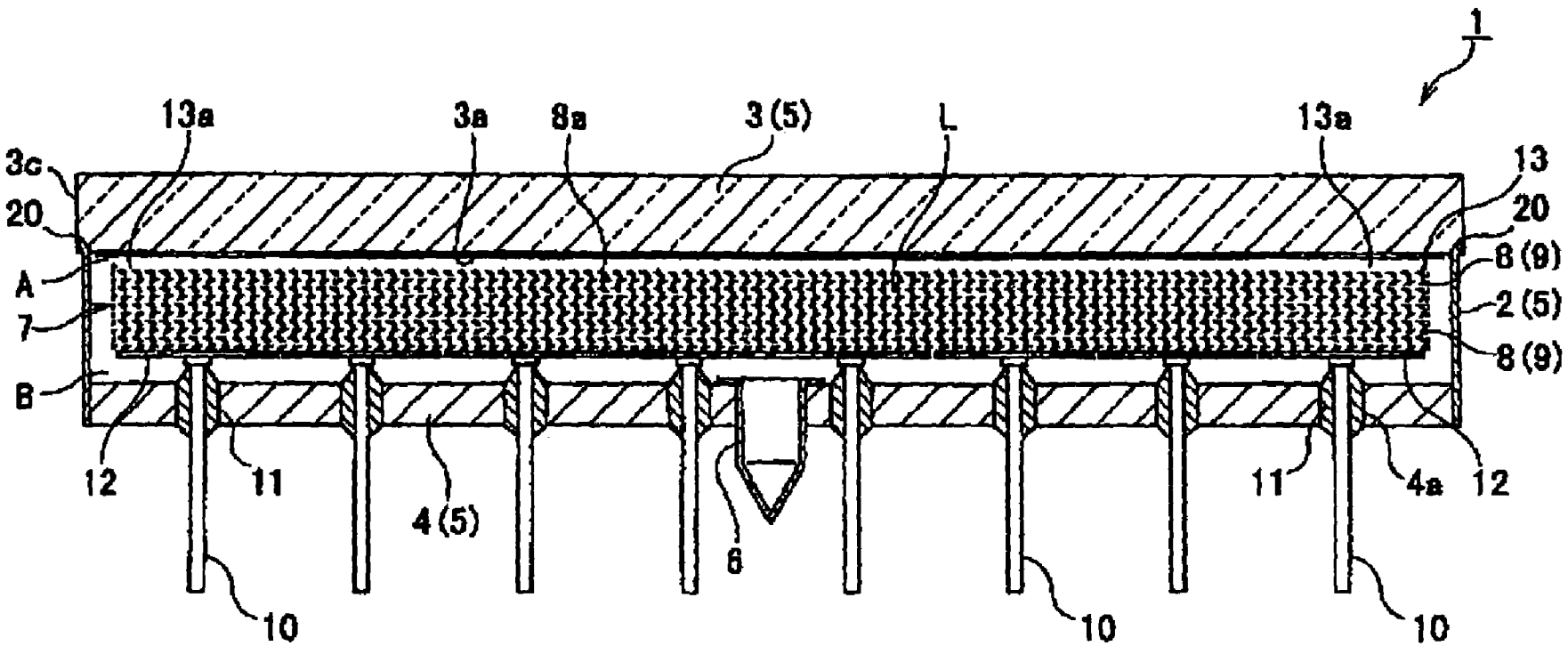
FIG. 2 is a cross-sectional view taken on line II-II.

FIG. 1 is a perspective view showing a photomultiplier tube according to the present invention. FIG. 2 is a cross-sectional view of the photomultiplier tube in FIG. 1. The photomultiplier tube 1 includes a side tube 2 having a substantially rectangular section and formed from a metal material (such as Kovar metal and stainless steel). A glass faceplate 3 is fused to one open end A of the side tube 2. A photocathode 3*a* for converting light to an electron is formed on an inner surface of the faceplate 3. The photocathode 3*a* is formed by reacting alkali metal vapor with antimony pre-deposited on the faceplate 3. A stem plate 4 made from a metal material (such as Kovar metal and stainless steel) is welded to the other open end B of the side tube 2. The assembly of the side tube 2, the faceplate 3, and the stem plate 4 forms a hermetically sealed vessel 5. The vessel 5 has a low height of approximately 10 mm.

A metal evacuating tube 6 is provided in the center of the stem plate 4. The evacuating tube 6 is used to evacuate the vessel 5 by a vacuum pump (not shown) after the assembly of the photomultiplier tube 1 is over. The evacuating tube 6 is also used for introducing alkali metal vapor into the vessel 5 during the production of the photocathode 3*a*.

A stacked electron multiplier 7 in a block shape is disposed inside the vessel 5. The electron multiplier 7 has an electron multiplying section 9 in which ten stages of flat dynodes 8 are stacked. Stem pins 10 formed from Kovar metal penetrate the stem plate 4 and support the electron multiplier 7 in the vessel 5. The tip of each stem pin 10 is electrically connected to each dynode 8. Pinholes 4*a* are formed in the stem plate 4, enabling the stem pins 10 to penetrate the stem plate 4. Each of the pinholes 4*a* is filled with a tablet 11 formed from Kovar glass, which forms a hermetic seal between the stem pins 10 and the stem plate 4. Each stem pin 10 is fixed to the stem plate 4 by the tablet 11. The stem pins 10 are classified into two groups: one group for the dynodes, and the other group for an anode.

The anodes 12 are positioned below the electron multiplying section 9 in the electron multiplier 7. The anodes 12 are fixed to the top ends of the anode pins 10. A flat focusing electrode 13 is disposed between the photocathode 3*a* and the electron multiplying section 9 above the top stage of the electron multiplier 7. A plurality of slit-shaped openings 13*a* is formed in the focusing electrode plate 13. The openings 13*a* extend in one direction. Slit-shaped electron multiplying holes 8*a* are formed in the dynode 8. The number of electron multiplying holes 8*a* is the same as that of the openings 13*a*. The electron multiplying holes 8*a* are arranged parallel to each other in one direction. The electron multiplying holes 8*a* extend in a direction substantially orthogonal to the surface of the dynodes 8.

Electron multiplying paths L are formed by arranging the electron multiplying holes 8*a* in each dynode 8 along the direction of the stack. A plurality of channels is formed in the electron multiplier 7 by associating the path L with the corresponding opening 13*a* in the focusing electrode plate 13. The anodes 12 are configured in an 8×8 arrangement, so that each anode 12 corresponds to a predetermined number of channels. Since the anode 12 is connected to the corresponding anode pin 10, output signals can be extracted through each anode pin 10.

Hence, the electron multiplier 7 has a plurality of linear channels. A predetermined voltage is applied across the electron multiplying section 9 and anodes 12 by the stem pin 10 connected to a bleeder circuit (not shown). The photocathode 3*a* and the focusing electrode plate 13 are maintained at the same potential. The potential of each dynode 8 is decreasing from the top of the dynode toward the anodes 12. Accordingly, incident light on the faceplate 3 is converted to electrons at the photocathode 3*a*. The electrons are guided into a certain channel by the electron lens effect generated by the focusing electrode plate 13 and the first stage of the dynode 8 on the top of the electron multiplier 7. The electrons guided into the channel are multiplied through each stage of the dynodes 8 while passing through the electron multiplying paths L. The electrons are collected by the anodes 12 to be outputted as an output signal.

Figure 3:
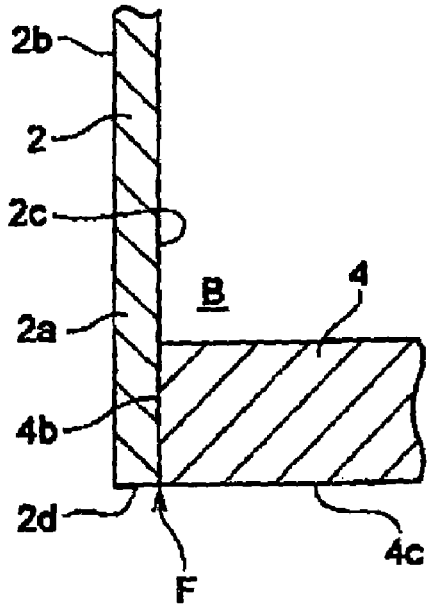
FIG. 3 is an enlarged cross-sectional view showing the relevant portion of the photomultiplier tube of FIG. 2.

Referring to FIG. 3, when the metal stem plate 4 and the metal side tube are hermetically fused, the stem plate 4 is inserted through the open end B of the side tube 2 so that an inner side wall 2*c* at a lower end 2*a* of the side tube 2 is in contact with a side face 4*b* of the stem plate. A lower end face 2*d* of the side tube 2 is approximately flush with a lower face 4*c* of the stem plate 4 in order that the lower end surface 2*d* does not project below the stem plate 4. Accordingly, the lower end 2*a* of the outer side wall 2*b* of the side tube 2 extends in the substantial axial direction of the tube 2, and eliminates lateral projection such as a flange at the lower end of the photomultiplier tube 1. In this embodiment, a junction F between the side tube 2 and stem plate 4 is laser-welded by irradiating a laser beam on the junction F from a point directly below and external to the junction F or in a direction toward the junction F.

By eliminating an overhang such as a flange at the lower end of the photomultiplier tube 1, it is possible to reduce the external dimensions of the photomultiplier tube 1, though the above structure of the photomultiplier tube 1 and the side tube 2 may be improper for resistance-welding. Further, when several photomultiplier tubes 1 are arranged in a unit for a given application, it is possible to minimize dead space between the neighboring photomultiplier tubes 1 as much as possible by placing the neighboring side tubes 2 of the photomultiplier tubes 1 close together. Laser welding is employed to bond the stem plate 4 and side tube 2 together in order to achieve a low height structure of the photomultiplier tube 1 and to enable high-density arrangements of the photomultiplier tube 1 in a unit.

The above laser welding is one example for fusing the stem plate 4 and side tube 2. When the side tube 2 and the stem plate 4 are welded together using the laser welding, it is unnecessary to apply pressure across the junction F between the side tube 2 and stem plate 4 in contrast to resistance welding. Hence, no residual stress is induced at the junction F, avoiding cracks from occurring at this junction during the usage. The usage of the laser welding greatly improves the durability and hermetic seal of the photomultiplier tube 1. Laser welding and electron beam welding prevent generation of heat at the junction F, compared to the resistance welding. Hence, when the photomultiplier tube 1 is assembled, there is very little effect of heat on the components in the vessel 5.

Figure 4:
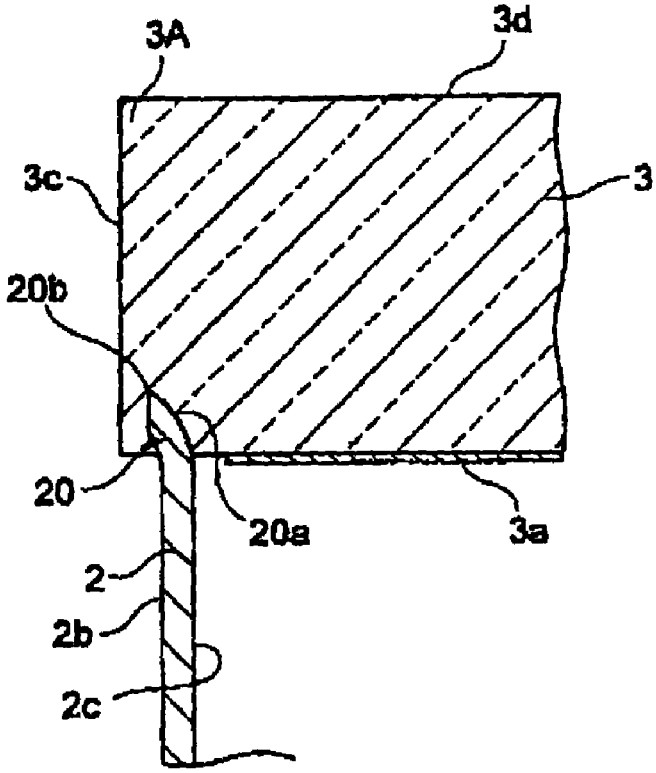
FIG. 4 is an enlarged cross-sectional view showing the relevant portion of the photomultiplier tube of FIG. 2.

The side tube 2 is formed by pressing a flat plate made from metal such as Kovar and stainless steel into an approximately rectangular cylindrical shape having a thickness of approximately 0.25 mm and a height of approximately 7 mm. The glass faceplate 3 is fixed to the open end A of the side tube 2 by fusion. As shown in FIG. 4, an edge portion 20 is formed on an upper end of the side tube 2 which the glass faceplate 3 faces. The edge portion 20 is provided around the entire upper end of the side tube 2. The edge portion 20 curves toward an exterior of the side tube 2 through a curved part 20*a* formed on an inner surface 2*c* side of the side tube 2. The edge portion 20 has a knife-edged tip 20*b*. Hence the top of the side tube 2 can easily pierce the glass faceplate 3, thereby facilitating the assembly process and improving reliability when the side tube 2 and glass faceplate 3 are fused together.

When fixing the side tube 2 with an edge portion 20 having the above shape to the glass faceplate 3, the metal side tube 2 is placed on a rotating platform (not shown) with a bottom surface of the glass faceplate 3 being in contact the tip 20*b* of the edge portion 20. Next, the metal side tube 2 is heated by a high-frequency heating device while the glass faceplate 3 is pressed downwardly to the side tube 2 by a pressure jig. At this time, the heated edge portion 20 of the side tube 2 gradually melts and penetrates the glass faceplate 3. As a result, the edge portion 20 is embedded into the glass faceplate 3, ensuring a hermetic seal at the juncture between the glass faceplate 3 and side tube 2.

The edge portion 20 extends upwardly from the side tube 2 rather than extends laterally from the side tube 2 like a flange. When embedding the edge portion 20 into the glass faceplate 3 as close as possible to a side surface 3*c*, it is possible to increase the effective sensitive surface area of the glass faceplate 3 to nearly 100% and to minimize the dead area of the glass faceplate 3 to nearly 0%.

Figure 5:
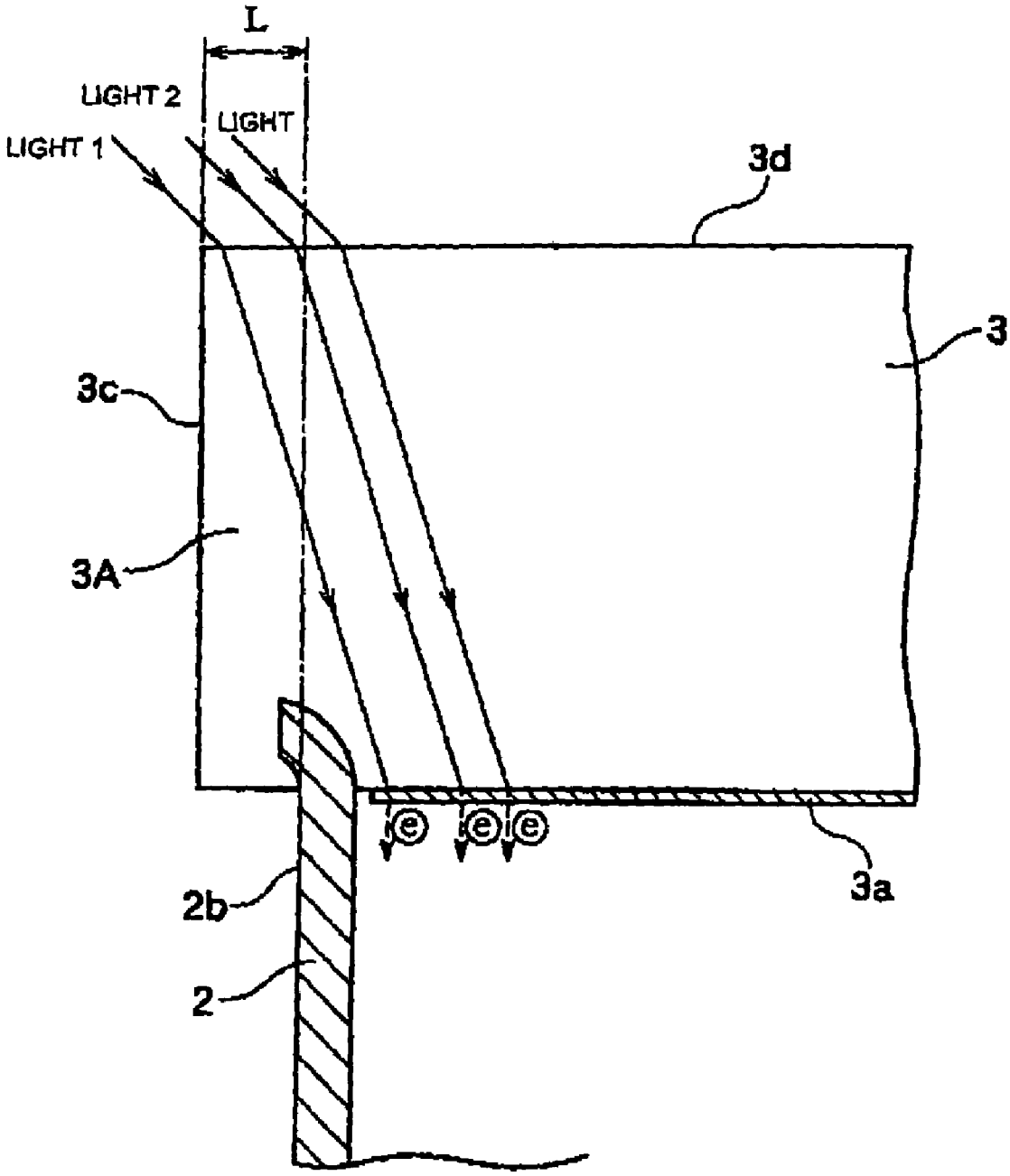
FIG. 5 is a view showing a relation between a faceplate and an incident light.

Referring to FIG. 5, a side surface 3*c* of the glass faceplate 3 protrudes with respect to the outer side wall 2*b* of the metal side tube 2 by a predetermined length. Accordingly, an overhanging part 3A with a protrusion having a predetermined length L is formed in the glass faceplate 3, thereby increasing the area for receiving light passing through a photocathode 3*a* on the glass faceplate 3. The above overhang structure of the faceplate 3 is provided on the basis of refractive index of glass. The above structure is directed to receive light as much as possible which a conventional photomultiplier tube is not capable of receiving. The above structure is for light incident on the faceplate to be guided to photocathode 3*a*. The thicker the faceplate 3 is, the more effectively the overhanging structure functions in terms of the light receiving. It should be noted that any protruding length L of the overhanging part is selected dependently on the relation between the thickness and the material of the faceplate 3. The faceplate 3 may be made from Kovar glass and quartz glass.

When the metal side tube 2 is fused to the glass faceplate 3, the fusing method described above is adopted due to joint between glass and metal. The overhanging part 3A of the faceplate 3 is effective at ensuring an area required to fuse the faceplate 3 and the overhanging part 3A. A longer length L of the protrusion 3A avoids deformation of the side face 3*c* of the faceplate 3 during the fusion to the side tube 2, thereby ensuring the shape of the side face 3*c* without deformation.

Figure 6:
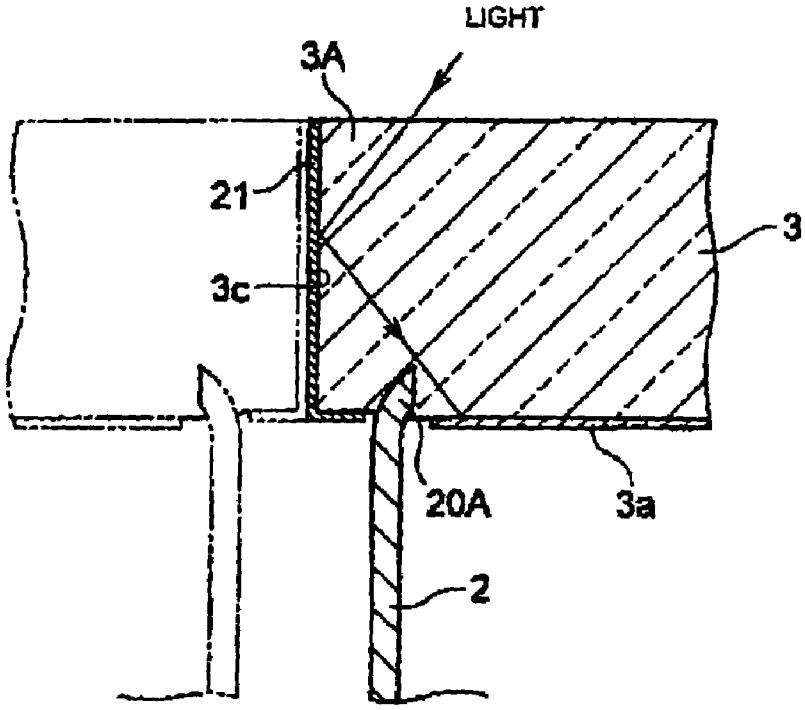
FIG. 6 is a cross-sectional view showing a reflecting member mounted on a faceplate.

Referring to FIG. 6, a reflecting member 21 may be provided on the side face 3*c* of the faceplate 3. The reflecting member 21 is made just by depositing an electrically conductive aluminum on the side face 3*c*. The reflecting member 21 can reflect a light beam which has struck a faceplate 3 and leaked out of the side face 3*c* due to lack of any reflecting member. Accordingly, the amount of light incident on the photocathode 3*a* is increased. And light receiving efficiency at the faceplate 3 is improved. The side tube has an edge portion 20A curving toward an interior thereof.

Figure 7:
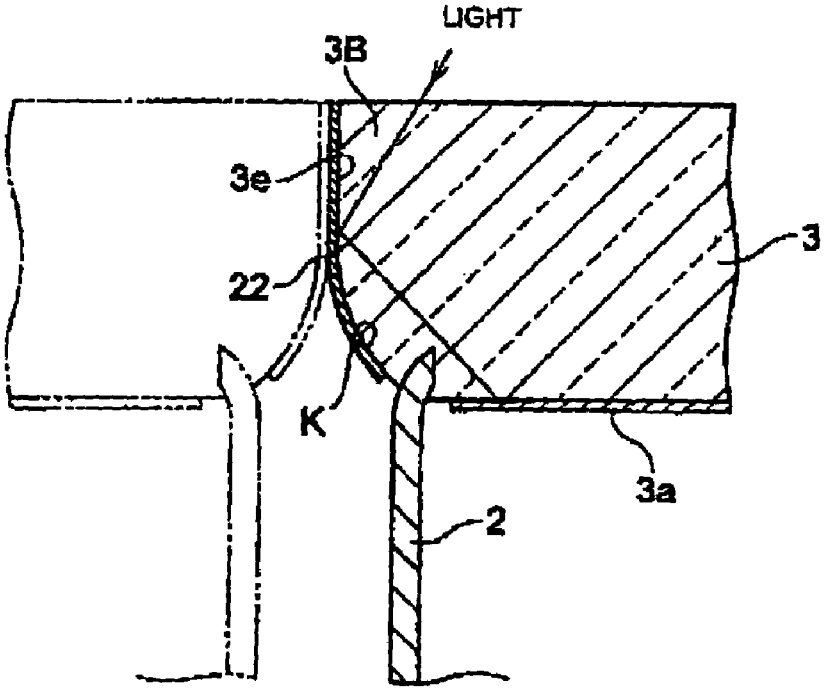
FIG. 7 is a cross-sectional view showing another embodiment of the faceplate.

FIG. 7 shows another embodiment of an overhanging part of the faceplate 3. The overhanging part 3B has a curved convex surface K at a lower end on the side face 3*e* of the faceplate 3. The reflecting member 22 is fixed on a side face 3*e*.

Figure 8:
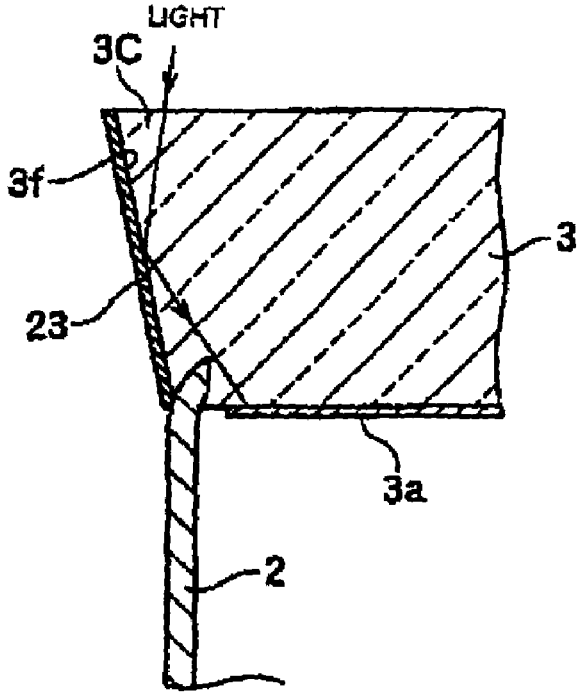
FIG. 8 is a cross-sectional view showing a further embodiment of the faceplate.

FIG. 8 shows a further embodiment of an overhanging part of the faceplate 3. An overhanging part 3C has a flat side face 3*f*. In other words, the side face 3*f* of the faceplate 3 is inclined with respect to an axial direction of the side tube 2 in order that a light receiving area is wider than a photocathode area on the faceplate 3. A reflecting member 23 is fixed to the side face 3*f*.

Figure 9:
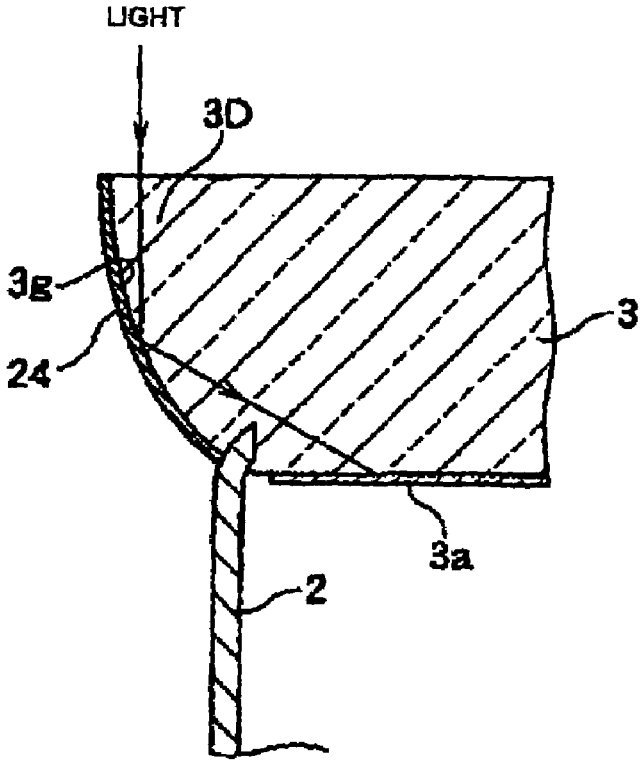
FIG. 9 is a cross-sectional view showing a still further embodiment of the faceplate.

FIG. 9 shows a still further embodiment of an overhanging part of the faceplate 3. The overhanging part 3D has an R-shaped side face 3*g*. In other words, the side face 3*g* has a convex curved shape as a whole. A reflecting member 24 is fixed on the side face 3*g*.

As described above, any one of the side faces 3*e*-3*g* is suitable for improving the light receiving efficiency. In particular, the side faces 3*c*, and 3*e* are appropriate for the faceplates 3 to arrange closely to each other.

Next, a preferred embodiment of a photomultiplier tube unit and a radiation detector according to the present invention will be described.

Figure 10:
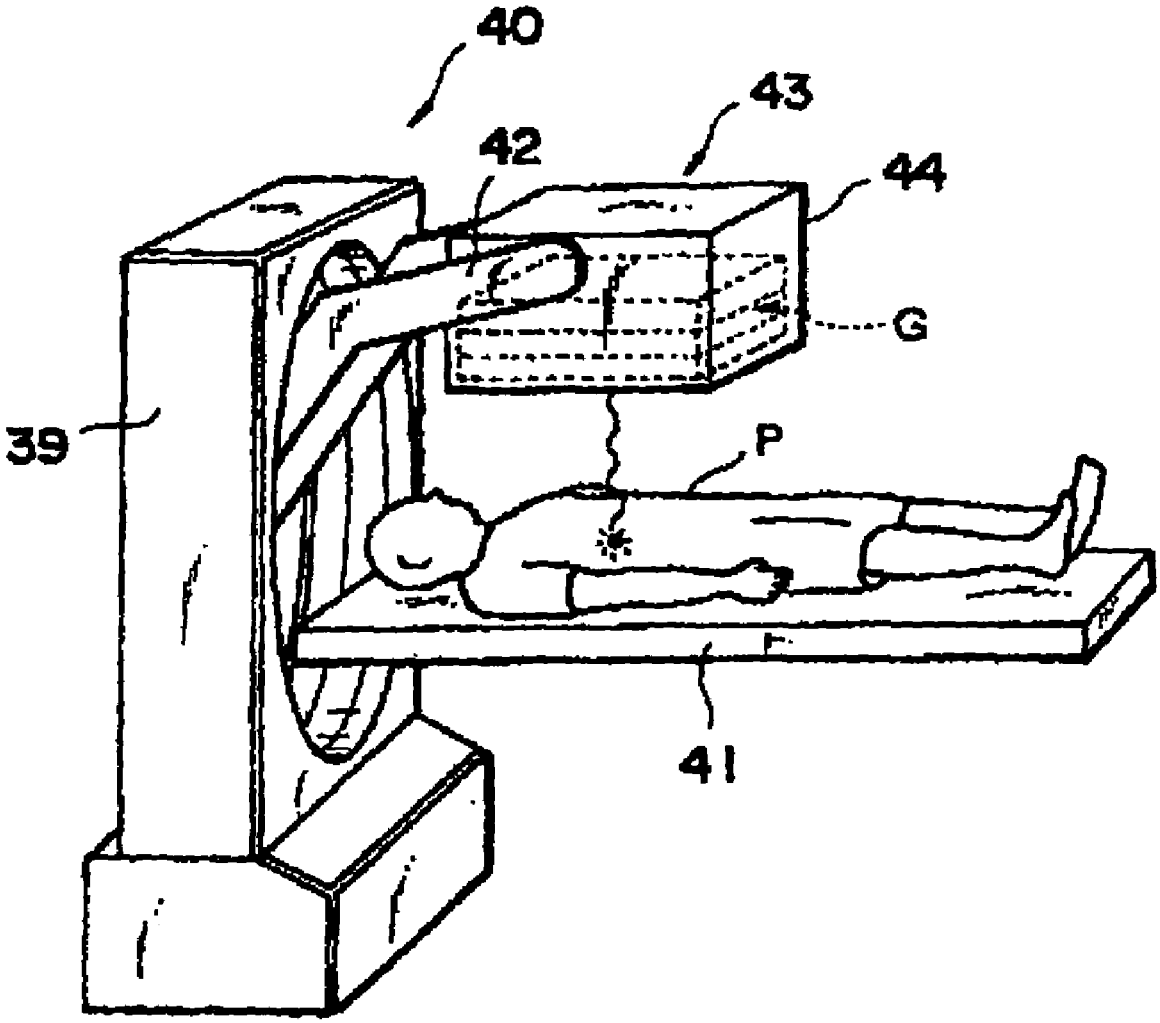
FIG. 10 is a perspective view showing an embodiment of a radiation detector according the present invention.

As shown in FIG. 10, a radiation detector 40 is a gamma camera as one example. The radiation detector 40 has been developed as a diagnostic device used in nuclear medicine. The gamma camera 40 has a detecting unit 43 supported by an arm 42 extending from a support frame 39. The detecting unit 43 is positioned directly above a bed 41 on which a patient P serving as the object of examination reclines.

Figure 11:
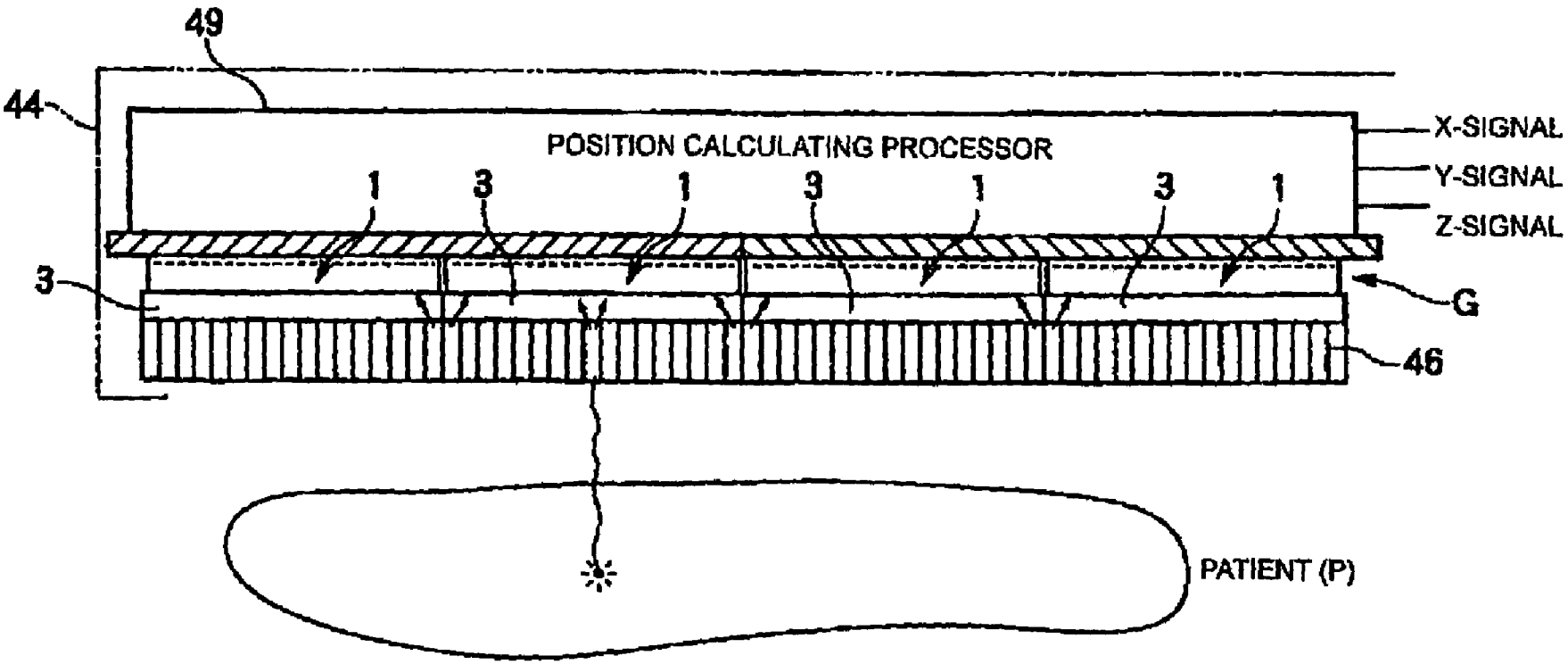
FIG. 11 is a side view showing the internal structure of a detecting unit used in the radiation detector.

As shown in FIG. 11, a casing 44 of the detecting unit 43 accommodates a scintillator 46 which is positioned opposite to the patient. The scintillator 46 is fixed directly to a group of photomultiplier tubes G without an interposing glass light guide. The group of photomultiplier tubes G includes a plurality of photomultiplier tubes 1 arranged densely in a matrix configuration. The faceplate 3 of each photomultiplier tubes 1 is orientated downwardly to the scintillator 46 in order to directly receive fluorescent light emitted from the scintillator 46. A conventional light guide is no longer needed, because the thickness of the faceplate 3 is increased to compensate for the thickness of the light guide.

A position calculating processor 49 is provided in the casing 44 for performing calculations based on electrical charges from each photomultiplier tube 1. The position calculating processor 49 generates an X signal, a Y signal, and a Z signal to form a three-dimensional image on a display (not shown). Gamma rays emitted from the affected part of the patient P are converted to predetermined fluorescent light by the scintillator 46. Each of the photomultiplier tubes 1 converts the energy of this fluorescent light into electrical charges. The position calculating processor 49 generates positions signals based on the electrical charges. In this way, it is possible to monitor the distribution of radiation energy from the object on the display for use in diagnoses.

While the above description has been given for the gamma camera 40 as one example of a radiation detector, another radiation detector used in nuclear medicine diagnoses is a Positron CT (commonly designated as PET). This apparatus also includes many the photomultiplier tubes 1.

Figure 12:
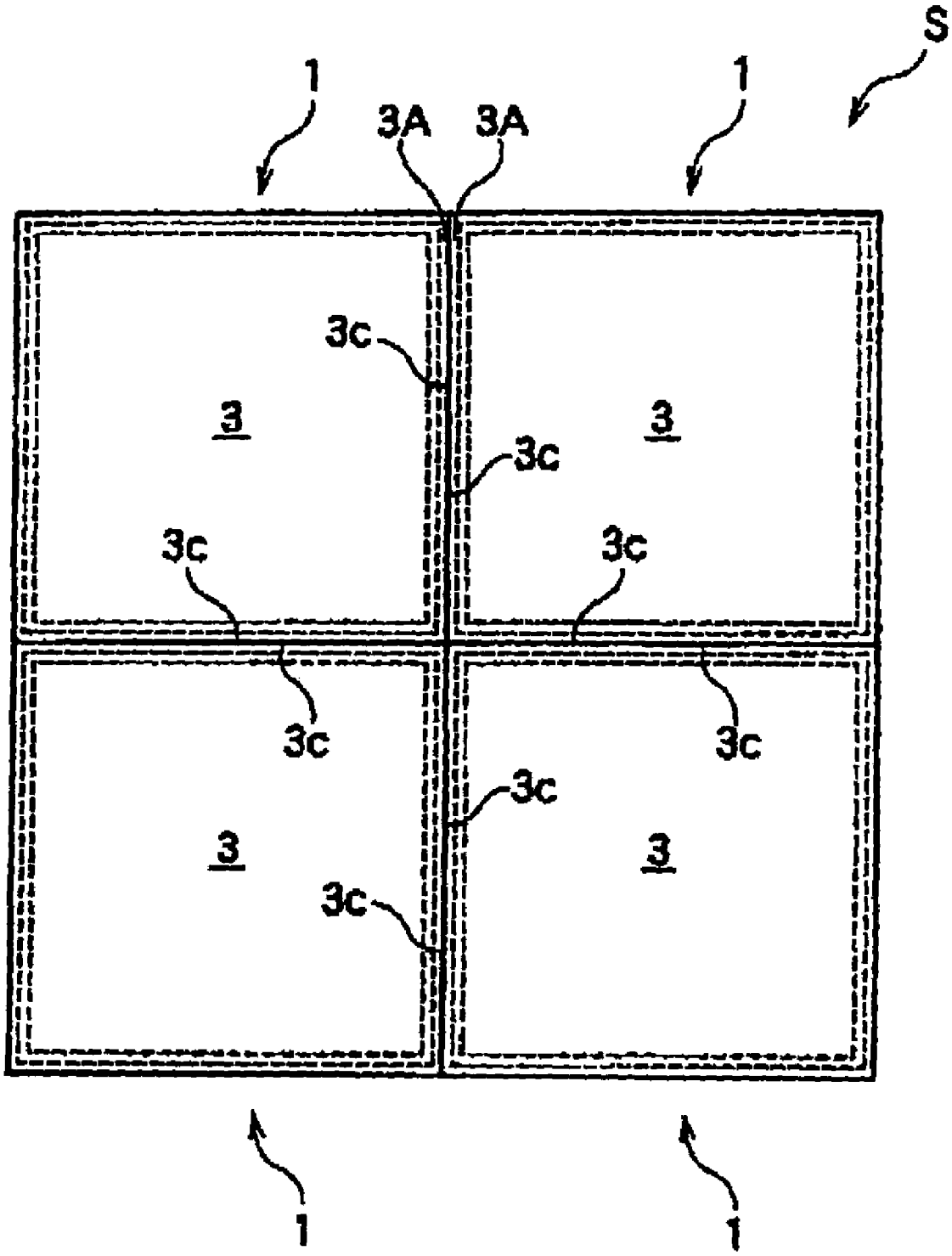
FIG. 12 is a plan view showing an embodiment of a photomultiplier tube unit according to the present invention.

Further, the group of photomultiplier tubes G has the photomultiplier tubes 1 arranged in a matrix. As shown in FIG. 12, the group of photomultiplier tubes G includes a photomultiplier tube unit S having four 2×2 of the photomultiplier tubes 1. The arrangement of the photomultiplier tubes 1 in the unit S is one example.

Next, the matrix-shaped photomultiplier tube unit S will be described in detail.

Figure 13:
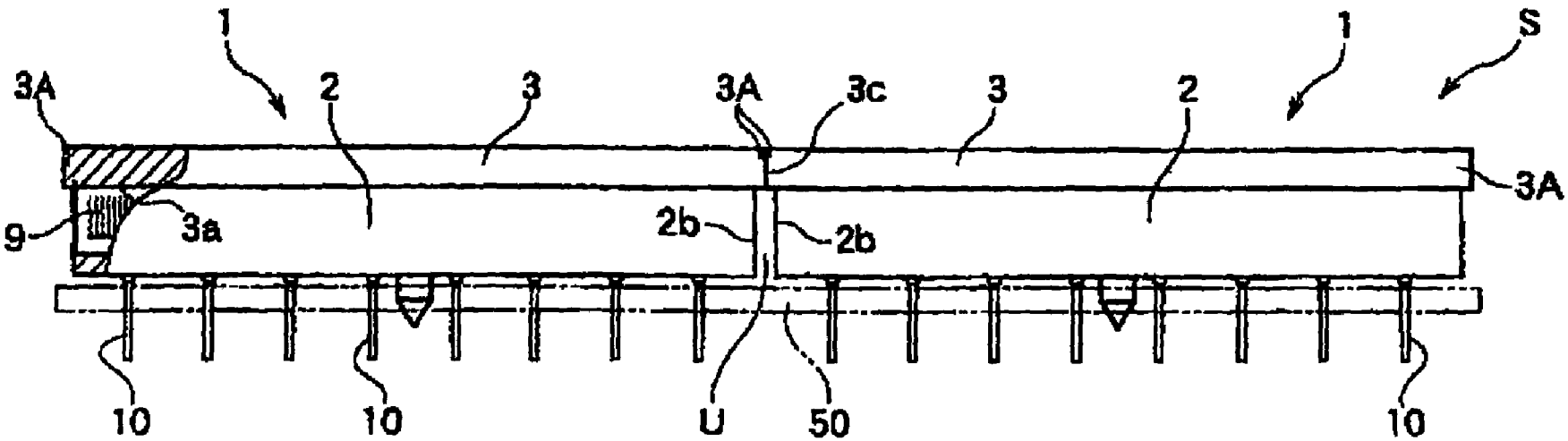
FIG. 13 is a side view showing the photomultiplier tube unit.

As shown in FIGS. 12 and 13, when configuring a photomultiplier tube unit S using the photomultiplier tubes 1 described above, the photomultiplier tubes 1 having the same structure are arranged on a substrate 50 made from resin or ceramic in a 2×2 matrix. The neighboring side surfaces 3*c* of the four faceplates 3 are in close contact, while neighboring side tubes 2 are separated from one another. Neighboring faceplates 3 can be easily and reliably fixed together by adhesive.

Figure 14:
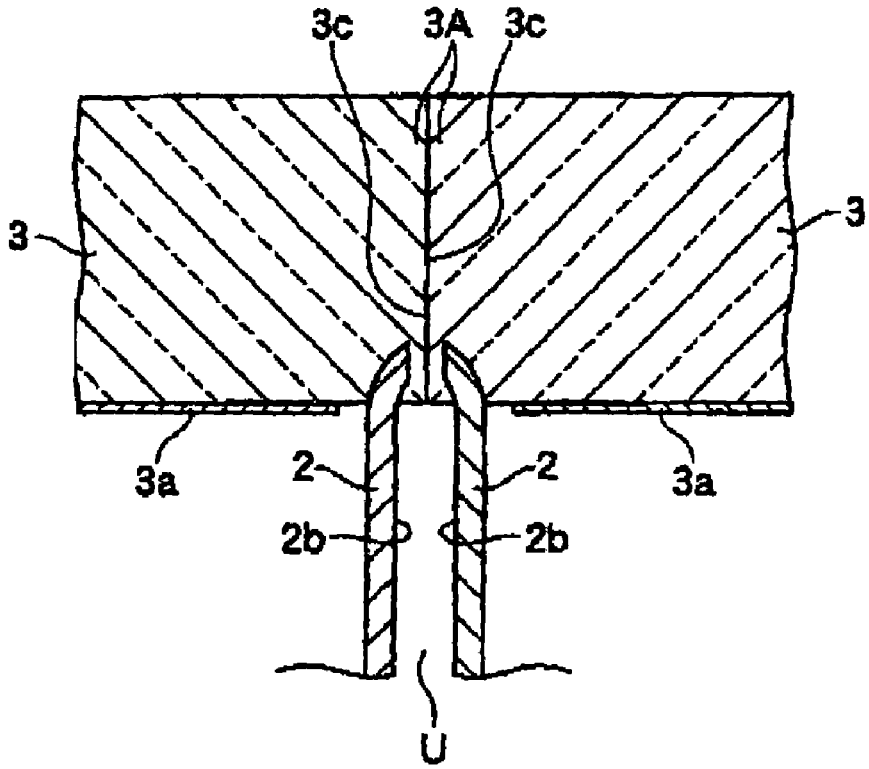
FIG. 14 is an enlarged view of FIG. 13.

Referring to FIGS. 13, and 14, the neighboring side faces 3*c* of the faceplates 3 having the overhanging part 3A face to each other. Therefore, the neighboring side tubes 2 are naturally spaced away from each other. Simultaneously, the faceplates 3 extend in such a manner that the joined faceplates 3 cover a gap U remaining between the neighboring side tubes 2. The photomultiplier tube 1 having an overhanging part 3A increases the effective sensitive area of the faceplate 3, while the neighboring side tubes 2 are spaced away from each other. The neighboring faceplates 3 are integral with each other and spaced away from each other, which facilitates gain control (current gain) at each electron multiplier section 9 through the stem pin 10. For example, when a negative high voltage is applied to the photocathode 3*a*, fine gain adjustment is necessary for each electron multiplier section 9 in order to maintain a constant gain for four intervals between the electron multiplier sections. The unit described above enables this gain control.

In order to assemble the unit S, the neighboring side faces 3*c* of the faceplates 3 may be fixed to each other through a reflecting member 21 such as aluminum, MgO, and teflon tape. This structure increases the amount of light which is reflected by the reflecting member 21 and strikes on the photocathode 3*a*, thereby improving the light receiving efficiency on the faceplate.

Figure 15:
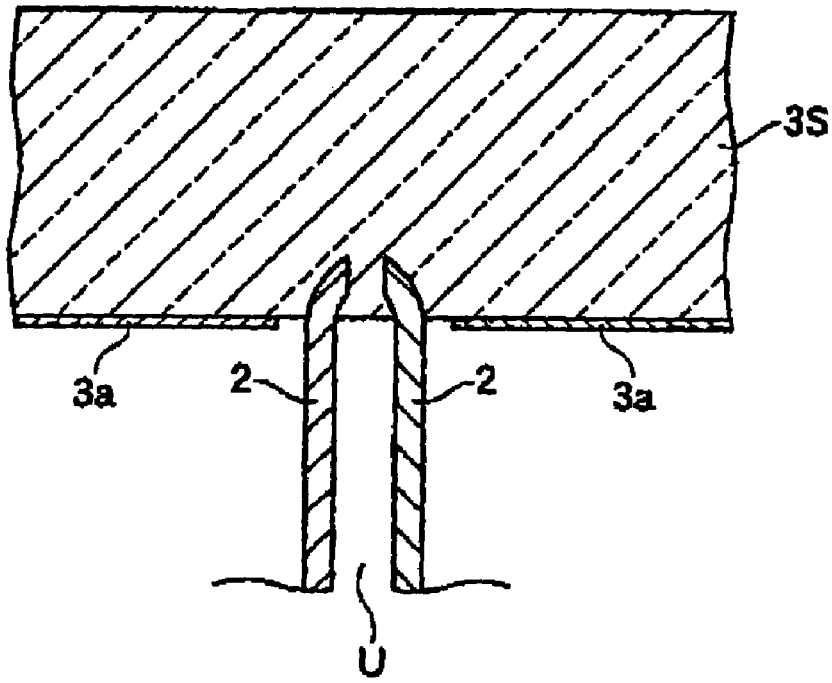
FIG. 15 is an enlarged cross-sectional view showing a main part of a photomultiplier tube unit having a single faceplate.

FIG. 15 shows one embodiment in which the neighboring side tubes are spaced away, and the neighboring side faces 3*c* of the faceplates are integral with each other. Four side tubes 2 may be secured on a single faceplate 3S in a matrix manner. Thus, if the single faceplate structure is adopted, uniform quality of the faceplate 3S is enhanced. At the same time, reliability of the unit S is improved.

Figure 16:
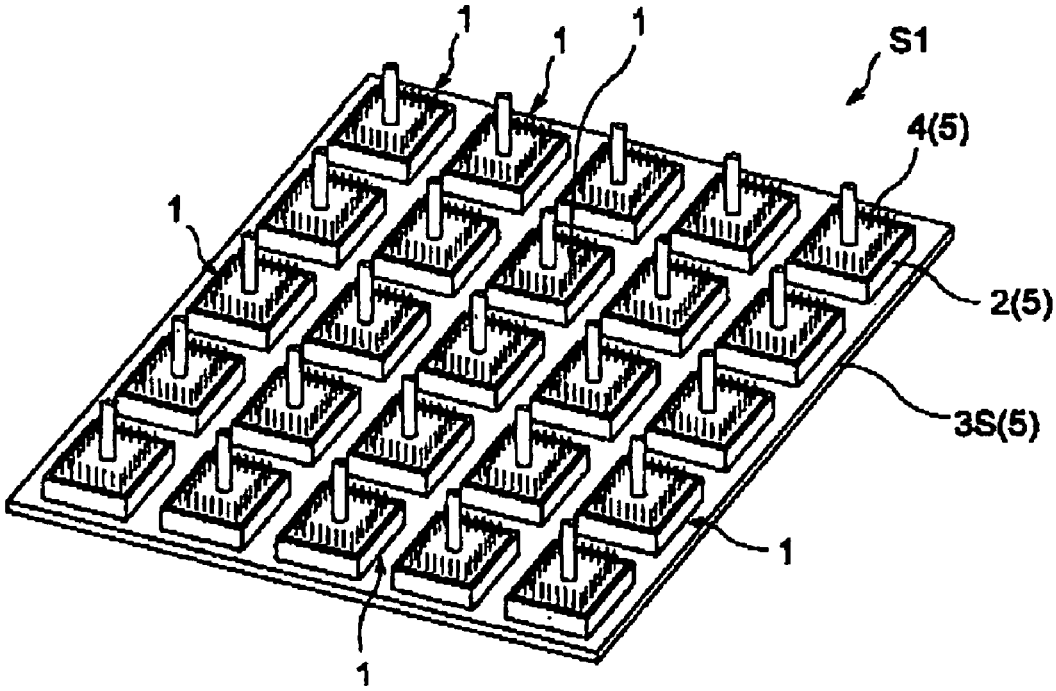
FIG. 16 is a perspective view showing another embodiment of the photomultiplier tube.

As another embodiment of a unit S1 in which many photomultiplier tubes 1 are arranged, FIG. 16 shows a unit S1 in which 25 side tubes 2 are arranged on a single faceplate 3S in a matrix manner to provide the hermetic sealed vessels 5. In this embodiment, the photomultiplier tubes 1 share the single faceplate 3S. The faceplate 3S can be cut at a desired position between the neighboring side tubes 2 by a glass cutter into some units, each units including any number of photomultiplier tubes. The unit having such a large size is suitable for mass production. For example, a photomultiplier tube 1 may be cut out one by one from the unit S1 in which many photomultiplier tubes 1 are arranged on the single faceplate 3S, if necessary.

Figure 17:
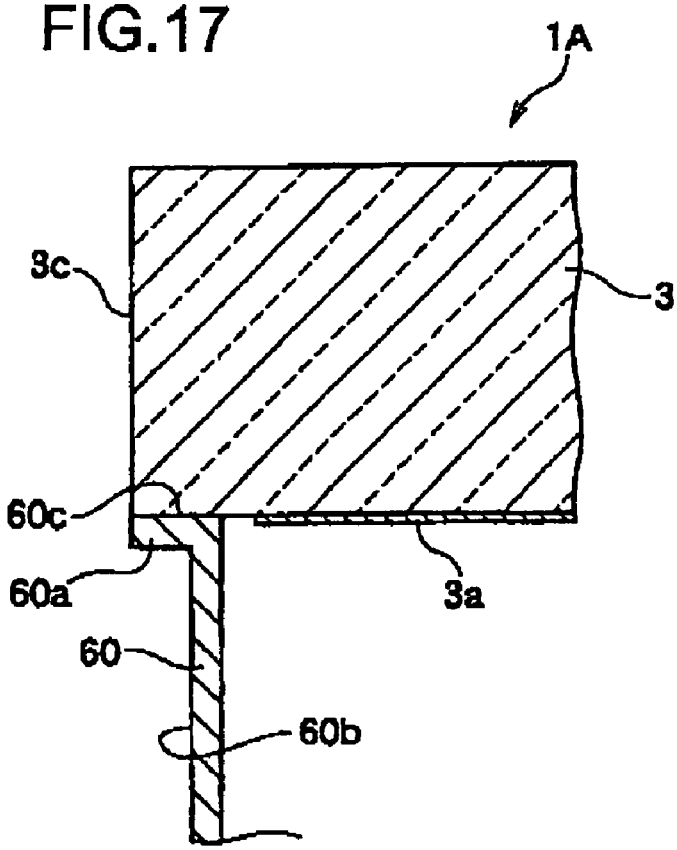
FIG. 17 is an enlarged cross-sectional view showing a further embodiment of the photomultiplier tube.
Figure 18:
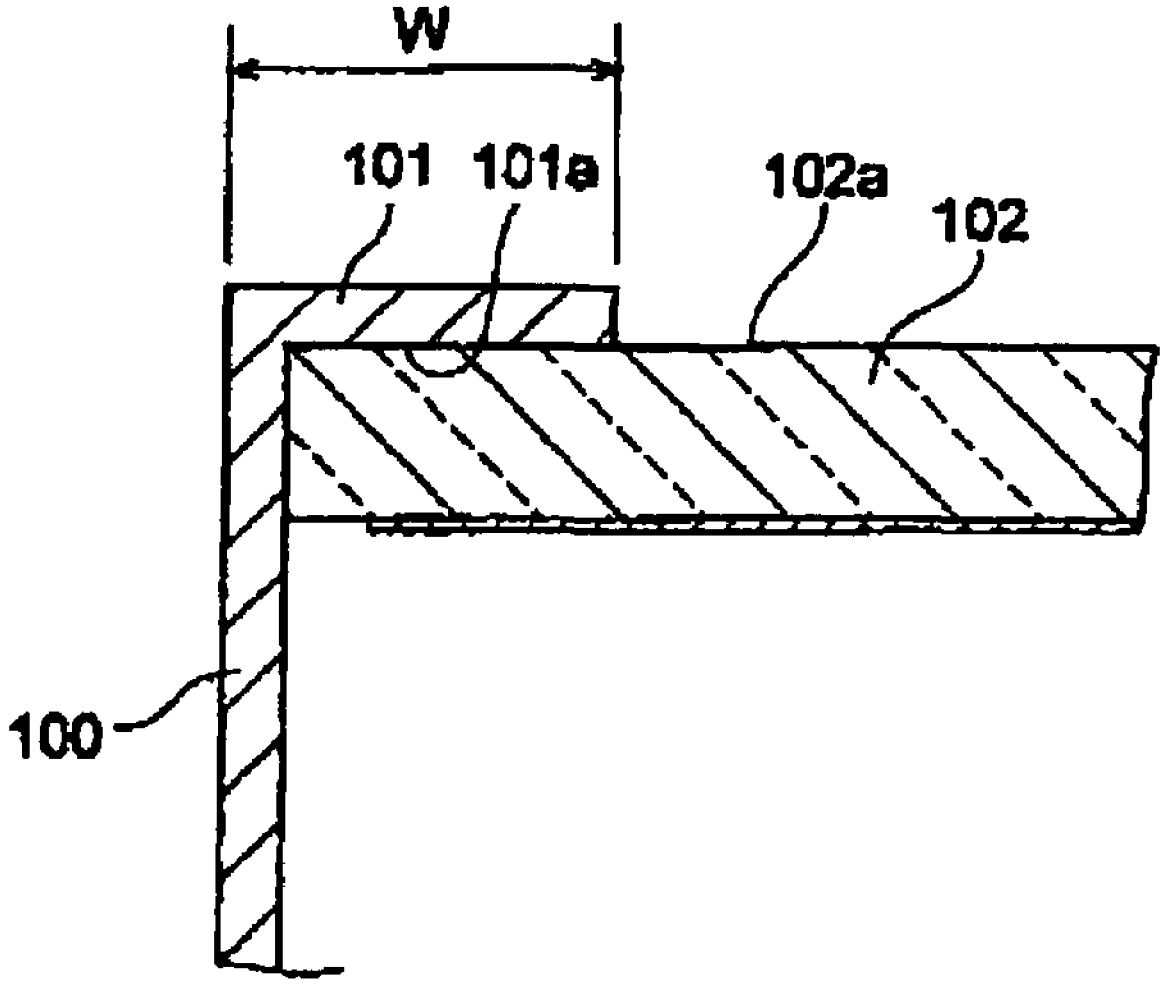
FIG. 18 is an enlarged cross-sectional view showing a conventional photomultiplier tube.

The present invention is not limited to the embodiments described above. For example, FIG. 17 shows a photomultiplier tube 1A in which a side tube 60 has a flange 60*a* extending outward, and a faceplate 3 may be fused to an upper face 60*c* of the flange 60*a*. In this case, the side face 3*c* of the faceplate protrudes outward from an outer side face 60*b* of the side tube 60. The shape of the faceplate 3 is not limited to a square. The faceplate 3 may have a rectangular or hexagonal shape.

INDUSTRIAL APPLICABILITY

A photomultiplier tube, a photomultiplier tube unit, and a radiation detector according to the present invention have a lot of different applications in imaging devices for a low luminescent object, such as gamma cameras.

The invention claimed is:

1. A photomultiplier tube comprising:

a faceplate made from glass for receiving light incident thereon;

a photocathode for emitting electrons in response to the light incident on the faceplate;

an electron multiplier for multiplying electrons emitted from the photocathode;

an anode for generating an output signal based on electrons multiplied by the electron multiplier;

a stem plate having a main surface having stem pins for fixing the electron multiplier and the anode thereon; and a metal side tube having an outer side wall extending along a tube axis, an inner side wall opposing the outer side wall, and two open ends for enclosing the electron multiplier and the anode, a first open end of the metal side tube being sealed to the stem plate, wherein the faceplate has two main surfaces and a side face between the two main surfaces, a first main surface of the faceplate receiving the light incident thereon, a second main surface of the faceplate being sealed with a second open end of the metal side tube, the side face including a curved convex portion near the second main surface of the faceplate, the curved convex portion being positioned on the outside of the metal side tube in a direction perpendicular to the tube axis, and the metal side tube has an edge portion on a peripheral portion of the second open end of the metal side tube, the peripheral portion penetrating the second main surface of the faceplate to be embedded therein with the edge portion being directly intimate with the faceplate.

2. The photomultiplier tube according to claim 1, wherein the edge portion has a tip end, and a distance between the tip end and the inner side wall in a direction perpendicular to the tube axis is shorter than a distance between the outer side wall and the inner side wall.

3. The photomultiplier tube according to claim 1, wherein the edge portions a knife-shaped tip end.

4. The photomultiplier tube according to claim 1, wherein the edge portion is heated while placed in contact with the faceplate, a part of the faceplate which is in contact with the edge portion is melted due to heat conducted from the edge portion, a pressing force is applied across the edge portion and the faceplate, thereby embedding the edge portion in the faceplate.

5. The photomultiplier tube according to claim 1, wherein the faceplate has a reflecting member on the side face of the faceplate.

6. The photomultiplier tube according to claim 1, wherein the side face of the faceplate further includes a flat portion near the first main surface, and the flat portion and the curved convex portion connect the first main surface to the second main surface.

7. A photomultiplier tube comprising:

a faceplate made from glass for receiving light incident thereon;

a photocathode for emitting electrons in response to the light incident on the faceplate;

an electron multiplier for multiplying electrons emitted from the photocathode;

an anode for generating an output signal based on electrons multiplied by the electron multiplier;

a stem plate having a main surface having stem pins for fixing the electron multiplier and the anode thereon; and a metal side tube having an outer side wall extending along a tube axis, an inner side wall opposing the outer side wall, and two open ends for enclosing the electron multiplier and the anode, a first open end of the metal side tube being sealed to the stem plate, wherein the faceplate has two main surfaces and a side face between the two main surfaces, a first main surface of the faceplate receiving the light incident thereon and having a wider area than a second main surface of the faceplate, the second main surface of the faceplate being sealed with a second open end of the metal side tube, and the side face being inclined a predetermined angle with respect to the tube axis of the side tube, and the metal side tube has an edge portion on a peripheral portion of the second open end of the metal side tube, the peripheral portion penetrating the second main surface of the faceplate to be embedded therein.

8. The photomultiplier tube according to claim 7, wherein the edge portion has a tip end, and a distance between the tip end and the inner side wall in a direction perpendicular to the tube axis is shorter than a distance between the outer side wall and the inner side wall.

9. The photomultiplier tube according to claim 7, wherein the edge portion is a knife-shaped tip end.

10. The photomultiplier tube according to claim 7, wherein the edge portion is heated while placed in contact with the faceplate, a part of the faceplate which is in contact with the edge portion is melted due to heat conducted from the edge portion, a pressing force is applied across the edge portion and the faceplate, thereby embedding the edge portion in the faceplate.

11. The photomultiplier tube according to claim 7, wherein the faceplate has a reflecting member on a side face of the faceplate.

12. A photomultiplier tube comprising:

a faceplate for receiving light incident thereon;

a photocathode for emitting electrons in response to the light incident on the faceplate;

an electron multiplier for multiplying electrons emitted from the photocathode;

an anode for generating an output signal based on electrons multiplied by the electron multiplier;

a stem plate having a main surface having stem pins for fixing the electron multiplier and the anode thereon; and a metal side tube having an outer side wall extending along a tube axis, an inner side wall opposing the outer side wall, and first and second ends, for enclosing the electron multiplier and the anode, the first end of the metal side tube being sealed to the stem plate, wherein the faceplate has first and second main surfaces and a side face between the first and second main surfaces, the first main surface of the faceplate receiving the light incident thereon, the second main surface of the faceplate being sealed with the second end of the metal side tube, the first main surface of the faceplate having a larger area than the second main surface of the faceplate so that the side face is non-parallel to a line normal to the first main surface of the faceplate, the side face including a curved convex portion near the second main surface of the faceplate, the curved convex portion being positioned on the outside of the metal side tube in a direction perpendicular to the tube axis, and the metal side tube has an edge portion on a peripheral portion of the second end of the metal side tube, the peripheral portion penetrating the second main surface of the faceplate to be embedded therein with the edge portion being directly intimate with the faceplate.

13. The photomultiplier tube according to claim 12, wherein the edge portion has a tip end, and a distance between the tip end and the inner side wall in a direction perpendicular to the tube axis is shorter than a distance between the outer side wall and the inner side wall.

14. The photomultiplier tube according to claim 12, wherein the edge portion is a knife-shaped tip end.

15. The photomultiplier tube according to claim 12, wherein the edge portion is heated while placed in contact with the faceplate, a part of the faceplate which is in contact with the edge portion is melted due to heat conducted from the edge portion, a pressing force is applied across the edge portion and the faceplate, thereby embedding the edge portion in the faceplate.

16. The photomultiplier tube according to claim 12, wherein the faceplate has a reflecting member on a side face of the faceplate.

* * * * *